US005249405A

United States Patent [19]

Miller

[11] Patent Number: 5,249,405

[45] Date of Patent: Oct. 5, 1993

[54] DRYWALL SUPPORT

[76] Inventor: George Miller, R.D. #1, Bennett Rd., Pine City, N.Y. 14871

[21] Appl. No.: 2,671

[22] Filed: Jan. 11, 1993

Related U.S. Application Data

[63] Continuation of Ser. No. 813,779, Dec. 27, 1991, abandoned.

[51] Int. Cl.[5] ..... E04B 1/38

[52] U.S. Cl. ..... 52/712; 52/714; 52/363

[58] Field of Search ..... 52/712, 361-363, 52/126.7, 127.1, 714, 127.2; 411/439, 442-449, 451, 456, 446, 475, 477-478, 488, 493, 498

[56] References Cited

U.S. PATENT DOCUMENTS

| | | | |
|---|---|---|---|
| 1,212,843 | 1/1917 | Struchen | 52/700 |
| 1,533,411 | 4/1925 | Heilman | 52/679 |
| 1,783,391 | 12/1930 | Schorr | 52/679 |
| 2,180,651 | 11/1939 | Williams | 52/303 |
| 2,236,082 | 3/1941 | Wright | 52/714 |
| 2,429,113 | 9/1942 | Warner . | |
| 2,612,813 | 9/1948 | Cohn . | |
| 2,816,436 | 3/1954 | Nelsson . | |
| 3,343,329 | 5/1964 | Pohutsky . | |
| 3,436,883 | 4/1969 | Charman | 52/127.1 |
| 3,901,471 | 8/1975 | Hilgers | 52/714 |
| 4,448,007 | 5/1984 | Adams | 52/489 |
| 4,481,749 | 11/1984 | Stirling | 52/714 |
| 4,498,272 | 2/1985 | Adam | 52/714 |
| 4,782,642 | 11/1988 | Conville | 52/714 X |
| 4,844,651 | 7/1989 | Partridge | 52/714 X |
| 4,995,605 | 2/1991 | Conville | 52/714 X |

*Primary Examiner*—Peter M. Cuomo
*Assistant Examiner*—Beth A. Aubrey
*Attorney, Agent, or Firm*—Richard C. Litman

[57] ABSTRACT

A drywall support device for the temporary support of drywall, such as for ceiling installation, during installation. This device is a small and compact device having a piercing end, a supporting tongue, and a striking end. The piercing end and the striking end are opposite one another and essentially in the same plane which is transverse to the plane in which the supporting tongue lies. The drywall support device has the piercing end merely driven substantially perpendicular into a ceiling joist by striking the striking end with a hammer. The tongue supports one end of the drywall sheet while the installer secures the opposite end working towards the support devices. Once the entire sheet is secured, the drywall support devices are removed and reused in the installation of the next sheet. The drywall support device is also useful for installing drywall sheets on walls with ceilings above standard height, such as in old homes where ceiling may be over eight feet or in homes with cathedral ceilings.

2 Claims, 2 Drawing Sheets

DRYWALL SUPPORT

This application is a continuation of application Ser. No. 07/813,779 filed on Dec. 27, 1991 now abandoned.

BACKGROUND OF THE INVENTION

1. Field of the Invention

The present invention relates to temporary supports to aid in the installation of drywall and more particularly, to support the drywall while the installer secures the drywall to the ceiling.

2. Description of the Prior Art

Installing drywall on the ceiling can be a cumbersome task. Trying to suspend the drywall as it is secured to the beams can be burdensome. In the past, drywall installers or "drywall hangers" as referred to in the trade have installed drywall on the ceilings with the assistance of another individual or, more commonly, with the use of a device know as a "deadman." A deadman, in its simplest form, is a device having a T configuration. A horizontal member is affixed to a vertical member. The height of the deadman is approximately the same height as the ceiling (some deadmen are adjustable). The deadman supports the drywall on its horizontal member. The vertical member is wedged between the floor and the ceiling beams, sandwiching the drywall between the horizontal member and the ceiling beams. Typically, in the case of a standard height ceiling (eight feet), the drywall hanger has been known to use a single deadman to support one end of the drywall while securing the other end. In this manner, the drywall hanger can work his way from the unsupported end to the end which is temporarily supported by the deadman. Once the installer reaches the end temporarily supported, the deadman is simply removed and the process repeated until all of the drywall is hung on the ceiling.

A temporary support for drywall in the form of a nail on device would ease the installation of drywall on the ceiling. U.S. Pat. No. 2,429,113 to WARNER (issued Oct. 14, 1947) discloses a fastener that is used to install shingle siding. The fastener is driven through both a previous course of shingles and a layer of sheathing. The fastener has an anchorage means to secure to the sheathing and an abutment or hook to support the bottom edge of the shingle. U.S. Pat. No. 2,612,813 to COHN (issued Oct. 7, 1952) described an attaching means for any number of practical uses but is more specifically designed to suspend duct work from ceiling beams. It is comprised of a shank having projections at one end which are driven perpendicularly into a wooden beam. The opposite end of the shank has a prong which is driven perpendicularly into the duct thereby supporting the duct from the beam. U.S. Pat. No. 3,343,329 to POHUTSKY (issued Sep. 26, 1967) discloses a clip for supporting acoustical ceiling tiles. The clip is secured to a ceiling beam supporting a primary supporting strip which spans from one joist to the next. The acoustical ceiling tiles are glued to these suspended strips.

Not one of the aforementioned devices facilitates the temporary suspension of drywall panels. They are not intended for temporary use or for use with drywall.

SUMMARY OF THE INVENTION

By the present invention, a drywall support device for the temporary support of drywall during installation is provided. The device is a flat metal member having a tongue perpendicularly attached. One end of the device is rectangular in shape while the other end has a sharp extension projecting beyond the tongue. The device is rigid so it may be driven into the ceiling beam and so the tongue will support the weight of the drywall. The device is driven into the ceiling joists adjacent the wall. The installer slides the drywall between the joists and the tongue of the device. With the one end supported, the installer begins to fasten the opposite end of the drywall to the ceiling joists working his way towards the supports. Once the installer reaches the supports, he or she simply removes the supports from their current location and nails the supports into the ceiling joist juxtaposed the previously installed sheet. The installer achieves the best results when at least two of the devices are used over a four foot span.

Accordingly, an object of the present invention is provide a device that would provide temporary support of drywall during the installation process and especially for use when installing drywall on the ceiling joists.

Another object of the present invention is to provide a small and compact device of unitary construction which is easy to use.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT(s)

Figure 1:
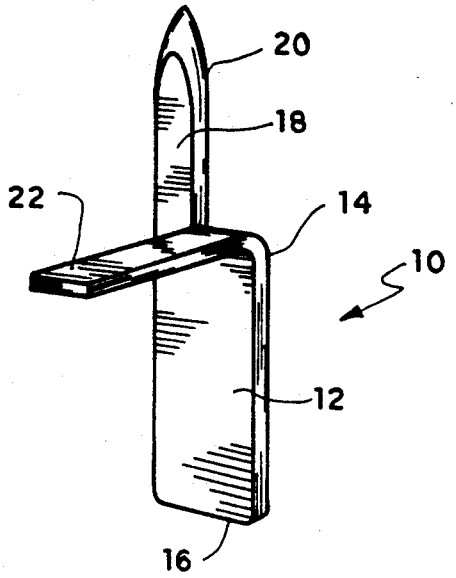
FIG. 1 is an elevational perspective view of the drywall support device according to the present invention.

Referring to FIG. 1, the present invention is a drywall support device 10 to facilitate the temporary support of a drywall sheet 24 during the installation process. The drywall support device 10 is a rigid structure comprised of a lower vertical element 12 which is a rectangular planar structure having a top end 14 and a bottom striking end 16. Along the top end 14 are disposed a vertical extension 18 and a horizontal support tongue 22. Both the vertical extension 18 and the horizontal support tongue 22 are an integral part of the lower vertical element 12. The vertical extension 18 has an uppermost end 20.

Figure 2:
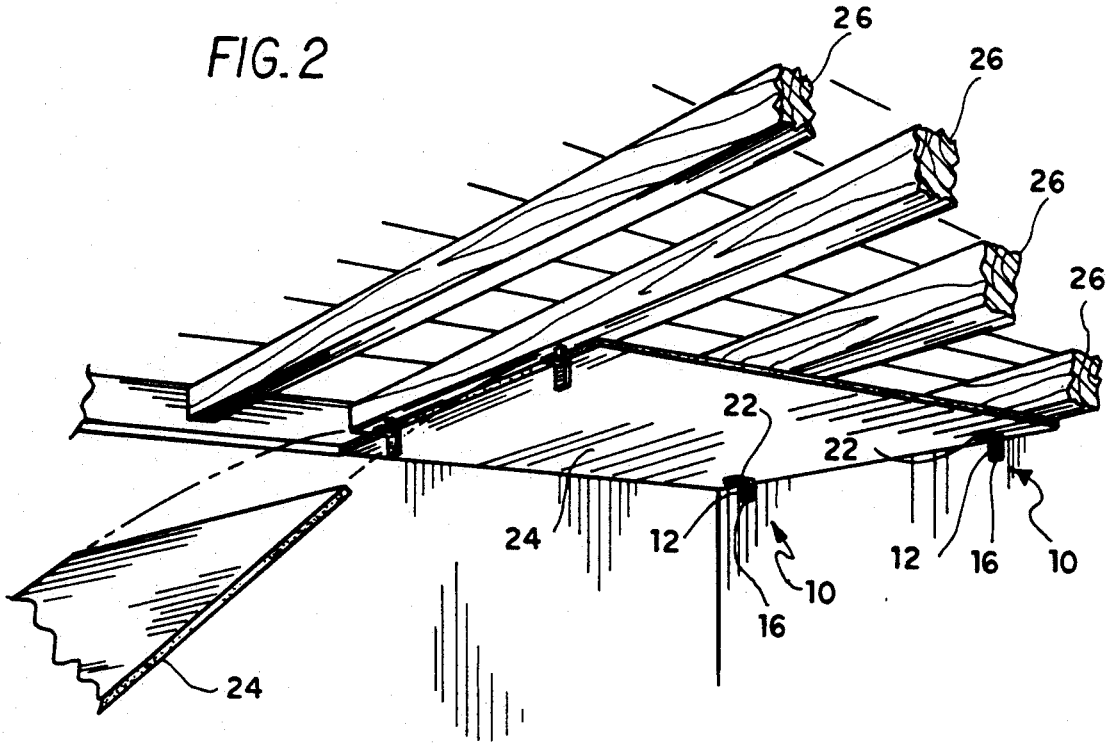
FIG. 2 is an environmental perspective view of the drywall support device according to the present invention showing it used in its preferred application.
Figure 3:
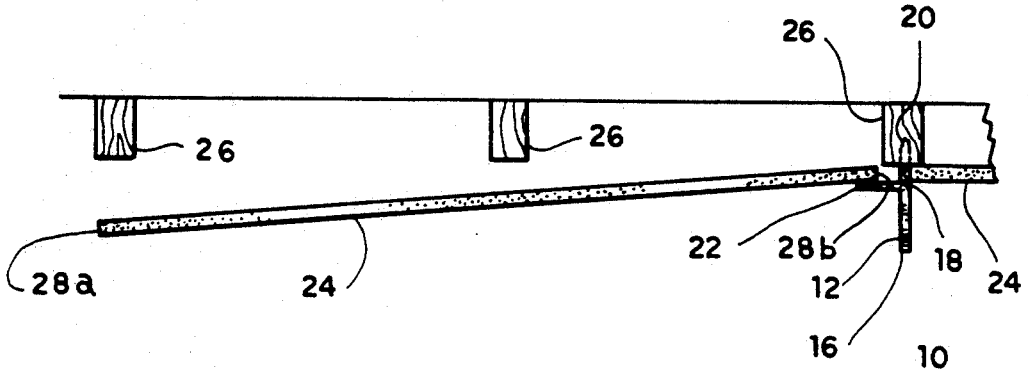
FIG. 3 is an environmental side elevational view of the drywall support device according to the present invention showing it used in its preferred application.

FIG. 2 and FIG. 3 show the drywall support device 10 for its intended application, installing drywall sheets 24 on ceiling joists 26. The device 10 is simple to use. Merely drive the piercing end 20 into the ceiling joist 26 by hammering against the striking end 16. The vertical extension 18 is of substantial length to bite the ceiling joist 26 and provide adequate space for the drywall sheet 24 to be longitudinally slid between the ceiling joist 26 and the horizontal support tongue 22. With the drywall sheet 24 being supported at one end **28*b*, the installer (not shown) can begin securing the drywall sheet 24 at the opposite end 28***a* working towards the supported end 28*b*. After the entire drywall sheet 24 is secured, the drywall support device 10 can be removed and reused to install the next drywall sheet 24 as shown in FIG. 2.

Figure 4:
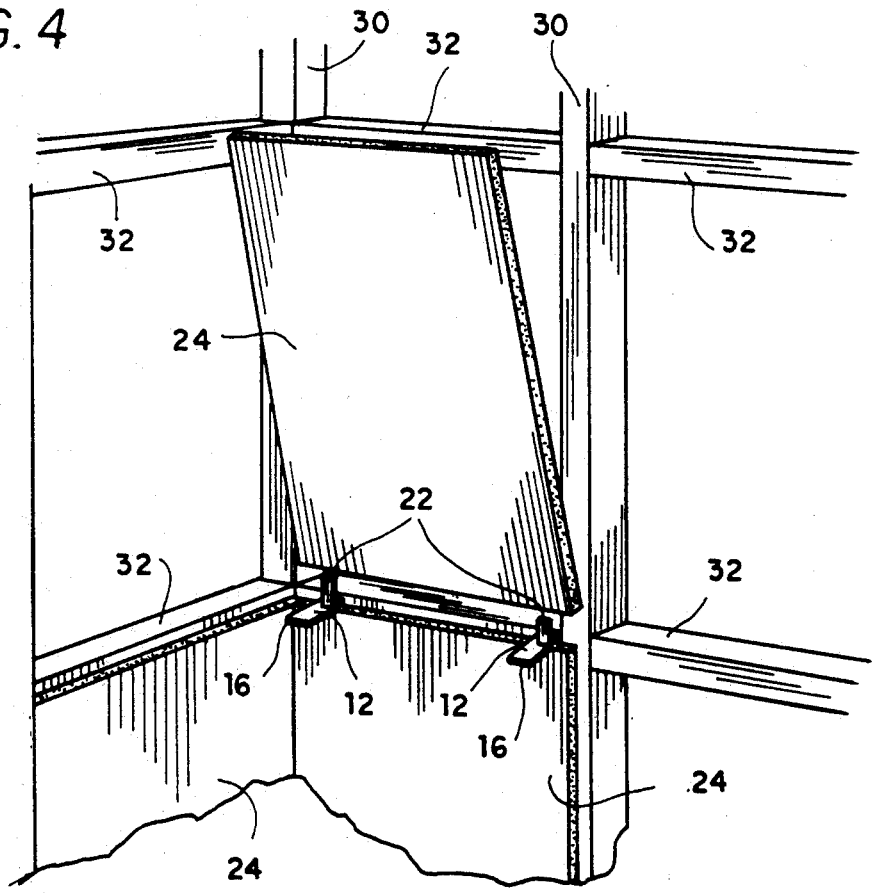
FIG. 4 is an environmental perspective view of the drywall support device according to the present invention showing it used in its alternative application.

FIG. 4 illustrates an alternative application of the drywall support device 10. The piercing end 20 can be driven horizontally into a wall beam 30 or a cross member 32 with the horizontal support tongue 22 directed vertically upward. Used in this manner, the drywall support device 10 will provide vertical support for the vertical placement of the drywall sheets 24. Drywall sheets 24 typically come in four foot by eight foot and four foot by twelve foot dimensions. If a ceiling is over eight feet tall, for example, if a ceiling is eight feet six inches, one will encounter a substantial amount of waste by cutting a twelve foot drywall sheet 24 down to eight feet six inches and an eight foot drywall sheet 24 simply will not be long enough. As another example, if the ceiling is a cathedral ceiling, the drywall sheets 24 will require a temporary vertical support as well. This drywall support device 10 will be useful in either case.

It is to be understood that the present invention is not limited to the sole embodiment described above, but encompasses any and all embodiments within the scope of the following claims.

I claim:

1. A panel support device to provide temporary support of panels during installation, said panel support device comprising:

a rigid structure having a substantially vertical lower element which includes a top and bottom end, said bottom end adapted to be struck with a hammer, and said top end having as an integral part a substantially vertical extension coplanar with said vertical lower element and having an uppermost end formed as a piercing end, and a single substantially horizontal rectangularly configured supporting tongue disposed at a right angle to said substantially vertical lower element and formed as an integral part of said top end of said substantially vertical lower element, adjacent to and abutting said substantially vertical extension, whereby said piercing end may be driven a predetermined distance into a beam of a building structure so as to maintain said supporting tongue spaced apart from the beam, a panel then being inserted into the space between the beam and said supporting tongue and being supported therebetween, whereafter the panel is secured to the beam, and then the panel support device is removed.

2. The panel support device according to claim 1, wherein said substantially vertical lower element is a rectangular planar structure and said substantially vertical extension is an elongated planar structure in the same plane as said substantially vertical lower element, and said supporting tongue is an elongated planar structure perpendicular to said substantially vertical lower element and said substantially vertical extension.

* * * * *